US008161742B2

(12) United States Patent
Sweeney et al.

(10) Patent No.: US 8,161,742 B2
(45) Date of Patent: Apr. 24, 2012

(54) ELECTRO-HYDRAULIC ACTUATOR MOUNTING

(75) Inventors: Timothy Sweeney, Osseo, NM (US); Paul T. Kubinski, Brooklyn Park, MN (US); David J. Anderson, Plymouth, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 839 days.

(21) Appl. No.: 12/186,215

(22) Filed: Aug. 5, 2008

(65) Prior Publication Data

US 2009/0041599 A1 Feb. 12, 2009

Related U.S. Application Data

(60) Provisional application No. 60/954,391, filed on Aug. 7, 2007.

(51) Int. Cl.
*F16D 31/02* (2006.01)

(52) U.S. Cl. ..... 60/476

(58) Field of Classification Search ..... 60/473, 60/475, 476

See application file for complete search history.

(56) References Cited

U.S. PATENT DOCUMENTS

| | | | | |
|---|---|---|---|---|
| 3,168,014 | A | 2/1965 | Aslan | |
| 3,168,853 | A | 2/1965 | Prince | |
| 3,182,443 | A | 5/1965 | Hermanns | |
| 3,474,710 | A | 10/1969 | Stryker | |
| 3,494,652 | A | 2/1970 | Langland | |
| 4,218,156 | A | 8/1980 | Logan | |
| 4,222,310 | A | 9/1980 | Garrett et al. | |
| 4,326,749 | A | 4/1982 | Bender | |
| 4,807,522 | A | 2/1989 | Saarela et al. | |
| 4,909,130 | A | 3/1990 | LaBair | |
| 5,117,633 | A * | 6/1992 | Bayer et al. | 60/473 |
| 5,144,801 | A | 9/1992 | Scanderbeg et al. | |
| 5,904,089 | A | 5/1999 | Jansson et al. | |
| 6,112,640 | A | 9/2000 | King | |
| 6,402,576 | B1 | 6/2002 | Klug | |
| 6,668,997 | B2 | 12/2003 | Sander et al. | |
| 7,100,492 | B2 | 9/2006 | Fish | |
| 2006/0168956 | A1 * | 8/2006 | Sakai et al. | 60/473 |
| 2007/0157612 | A1 * | 7/2007 | He | 60/413 |

OTHER PUBLICATIONS

KYB America LLC, Mini-Motion Package, catalog, front cover, Kayaba Industry Co., LTD, Tokyo, Japan.

Parker Hannidin Corporation, Oildyne Division, Compact Fluid Power Systems, Catalog HY22-1121/US, 2005 Minneapolis MN.

* cited by examiner

*Primary Examiner* — Michael Leslie

(74) *Attorney, Agent, or Firm* — Renner, Otto, Boisselle & Sklar, LLP

(57) ABSTRACT

An electro-hydraulic actuator includes a hydraulic pump, an electric motor operatively connected to the hydraulic pump and operable for driving the pump, an actuator moveable in response to fluid flow from the pump, and a housing for the pump, electric motor and actuator. The housing has a base member that is adapted to be modified into various configurations for forming an attachment interface for mounting of the electro-hydraulic actuator.

10 Claims, 8 Drawing Sheets

ELECTRO-HYDRAULIC ACTUATOR MOUNTING

CROSS REFERENCE TO RELATED APPLICATIONS

The present application claims the benefit of the filing date of U.S. Provisional Patent Application Ser. No. 60/954,391 filed Aug. 7, 2007, the disclosure of which is incorporated herein by reference.

TECHNICAL FIELD

This invention relates to an electro-hydraulic actuator. More particularly, this invention relates to an electro-hydraulic actuator in which the housing includes a base member that is adapted to be modified into various mounting configurations.

BACKGROUND OF THE INVENTION

Electro-hydraulic actuators are generally known. A typical electro-hydraulic actuator includes an electric motor that drives a hydraulic pump to move fluid from a reservoir to a hydraulic actuator for actuating the actuator. When the electric motor is driven in a first rotational direction, the hydraulic fluid moved by the hydraulic pump extends a rod of the actuator. When the electric motor is driven in a second rotational direction, opposite the first rotational direction, the hydraulic fluid moved by the hydraulic pump retracts the rod of the actuator.

The components of an electro-hydraulic actuator are supported in a housing. The housings of many known electro-hydraulic actuators include a first portion for the actuator and a second portion, connected to the first portion, for the electric motor, hydraulic pump, and reservoir.

Some electro-hydraulic actuators include an attachment interface for use in mounting the housing to another structure. The attachment interface is cast as part of the housing. For example, one known electro-hydraulic actuator includes a male clevis that is cast as a finished part with the housing. With known electro-hydraulic actuators, each unique attachment interface requires unique tooling for the manufacture of the housing.

SUMMARY OF THE INVENTION

The present invention relates to an electro-hydraulic actuator. The electro-hydraulic actuator comprises a hydraulic pump, an electric motor, an actuator, and a housing for the pump, electric motor and actuator. The electric motor is operatively connected to the hydraulic pump and is operable for driving the pump. The actuator is moveable in response to fluid flow from the pump. The housing has a base member that is adapted to be modified into various configurations for forming an attachment interface for mounting of the electro-hydraulic actuator.

DETAILED DESCRIPTION OF THE INVENTION

Figure 7:
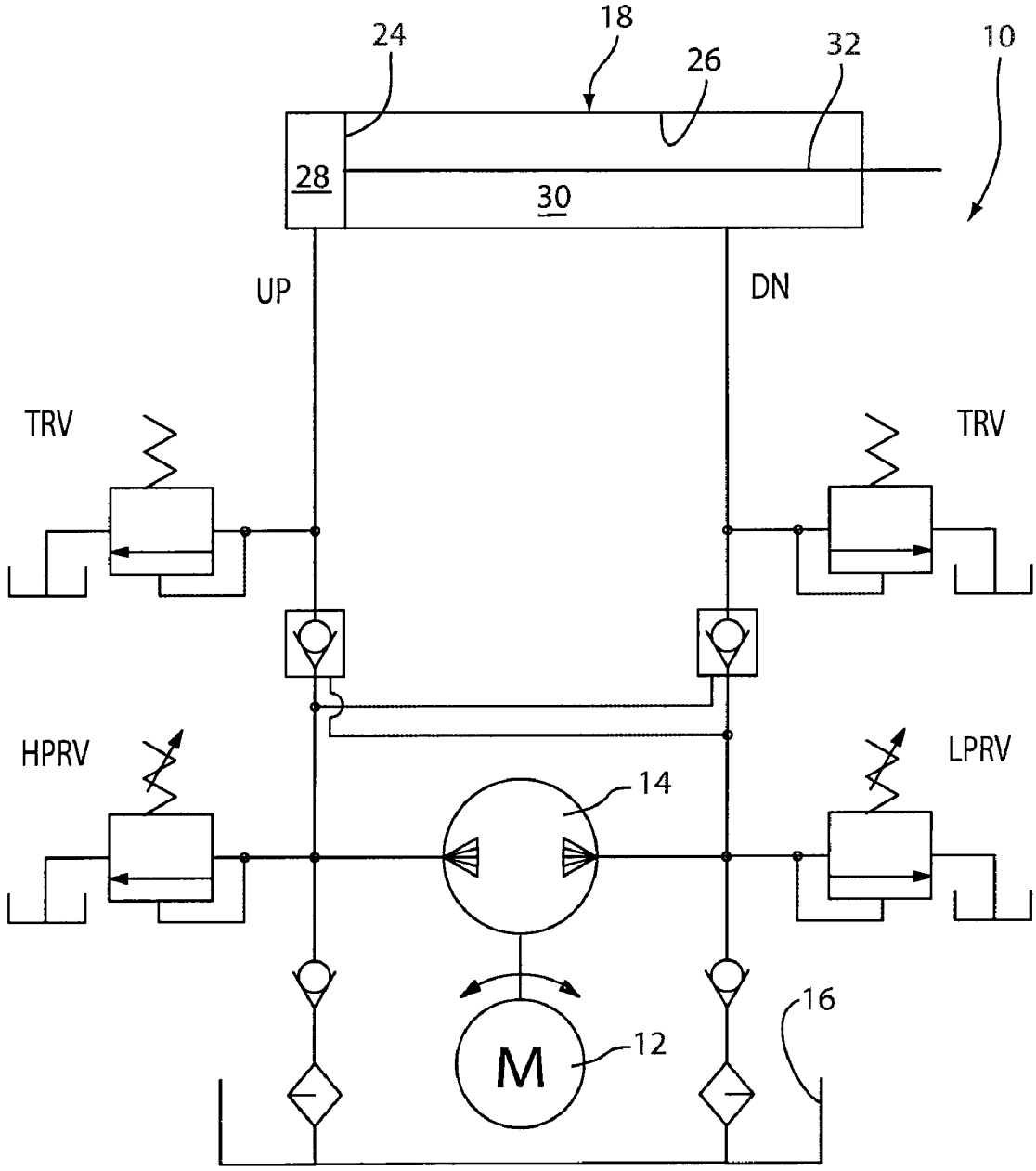
FIG. 7 is a schematic illustration of an electro-hydraulic actuator.

FIG. 7 is a schematic illustration of an electro-hydraulic actuator 10. The electro-hydraulic actuator 10 includes an electric motor 12 that is operatively coupled to a hydraulic pump 14. The electric motor 12 is operable for driving the hydraulic pump 14 in opposite first and second rotational directions for driving the hydraulic pump. The hydraulic pump 14 draws fluid from a reservoir 16 and provides the fluid to an actuator 18. The actuator 18 includes a piston 24 that is movably mounted within a cylinder bore 26. The piston 24 divides the cylinder bore 26 into first and second chambers 28 and 30, respectively. A rod 32 of the actuator 18 which is affixed to or integral to the piston 24 extends through the second chamber 30 and outwardly of a housing 40 (FIG. 1) of the electro-hydraulic actuator 10.

The electro-hydraulic actuator 10 is operable for extending or retracting the rod 32 relative to the housing 40 for causing relative movement of two structures, one attached to the housing and the other attached to the rod. To extend the rod 32 of the electro-hydraulic actuator 10, the electric motor 12 is operated to drive the hydraulic pump 14 in a first rotational direction causing hydraulic fluid drawn from the reservoir 16 to be directed into the first chamber 28 of the actuator 18. The fluid directed into the first chamber 28 creates a pressure differential between the first and second chambers 28 and 30 of the actuator 18 that moves the piston 24 to increase the volume of the first chamber 28 and decrease the volume of the second chamber 30, thus extending the rod 32. To retract the rod 32, the electric motor 12 is operated to drive the hydraulic pump 14 in a second rotational direction, opposite the first rotational direction, causing hydraulic fluid drawn from the reservoir 16 to be directed into the second chamber 30 of the actuator 18. The fluid directed into the second chamber 30 creates a pressure differential in which the pressure in the second chamber is higher than that in the first chamber 28. As a result of the differential pressure, the piston 24 moves to increase the volume of the second chamber 30 and decrease the volume of the first chamber 28, thus retracting the rod 32.

Figure 1:
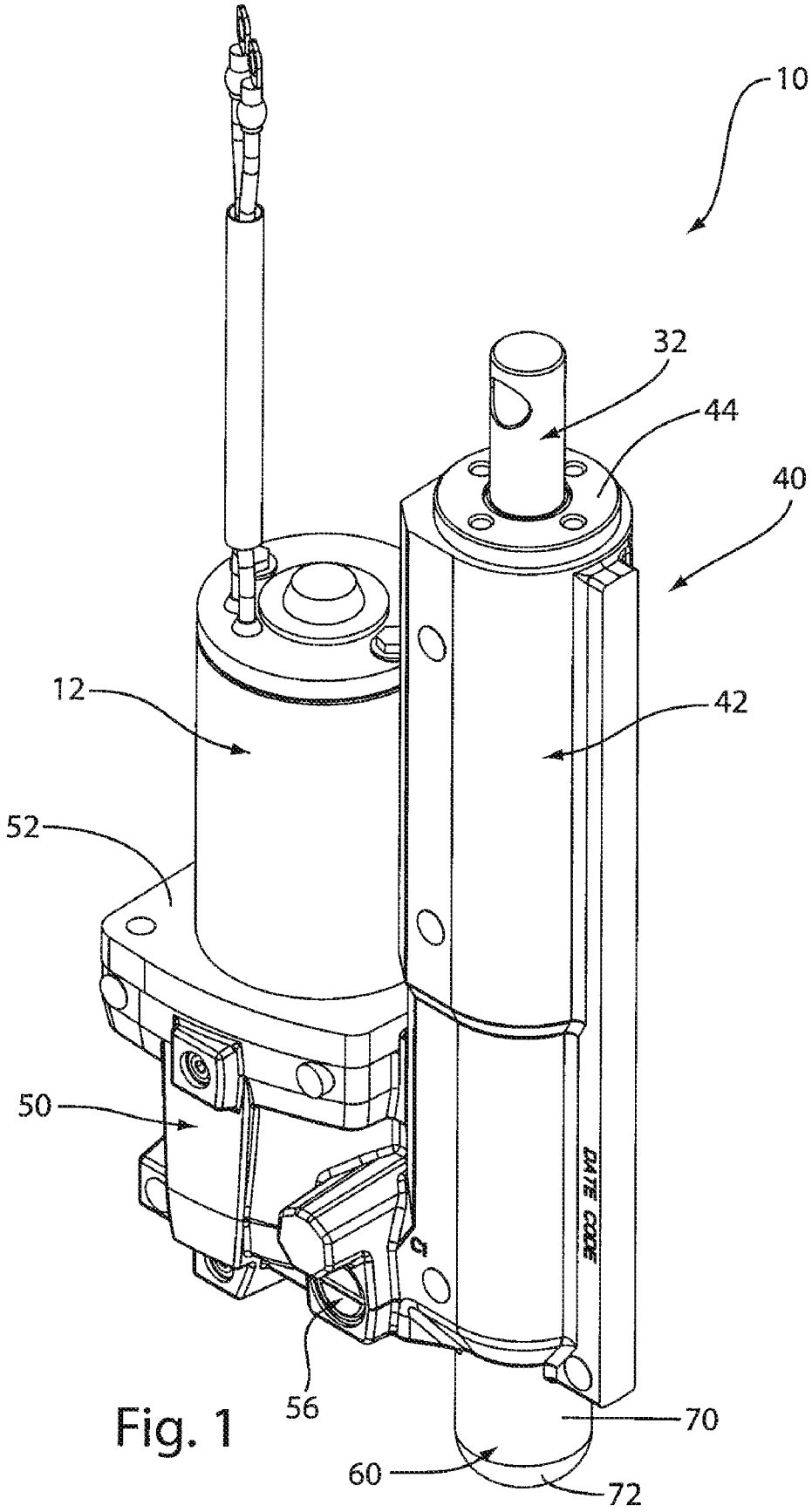
FIG. 1 is a perspective view of an electro-hydraulic actuator constructed in accordance with the present invention.
Figure 2:
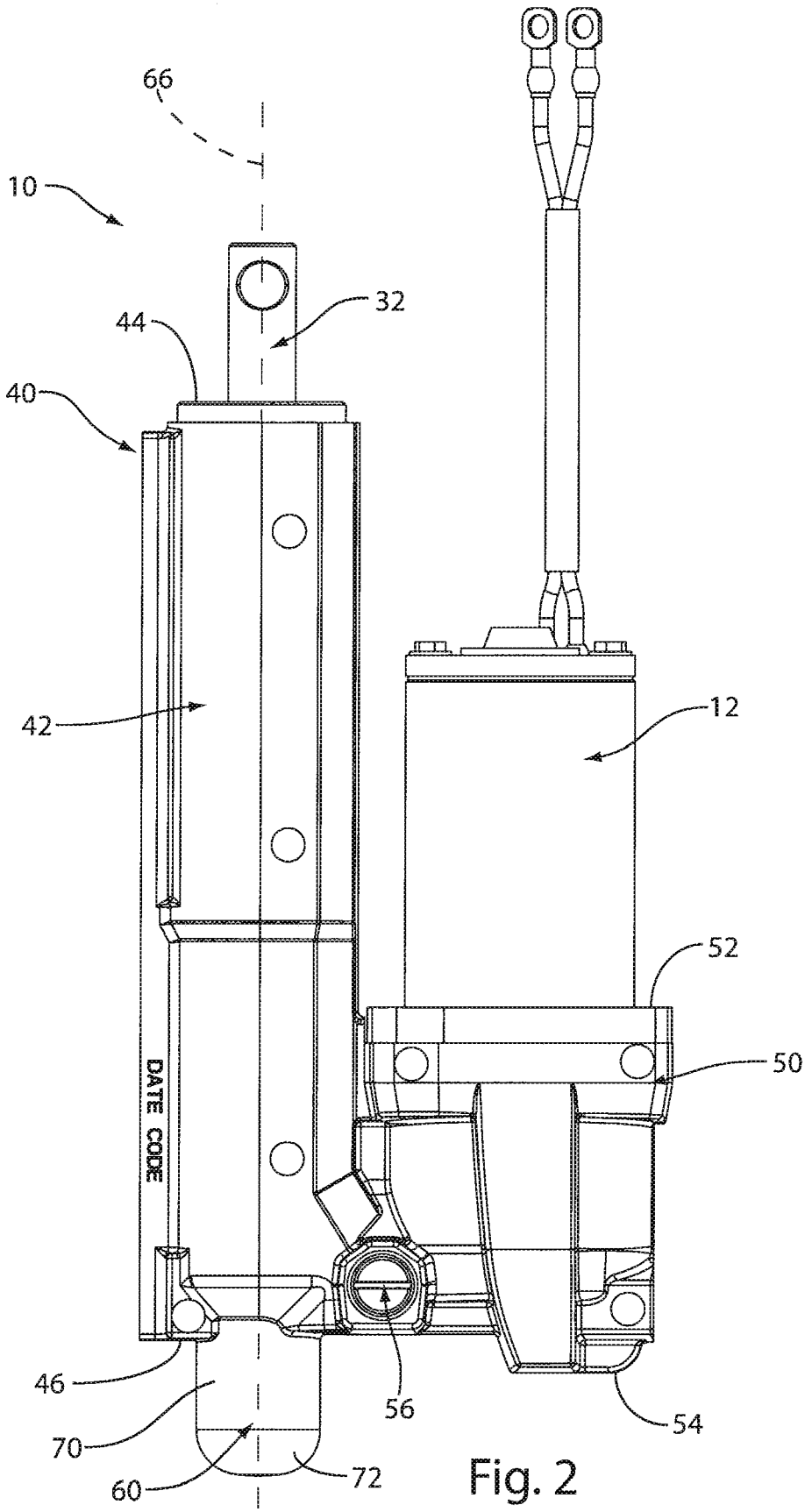
FIG. 2 is an elevation view of the electro-hydraulic actuator of FIG. 1.
Figure 3:
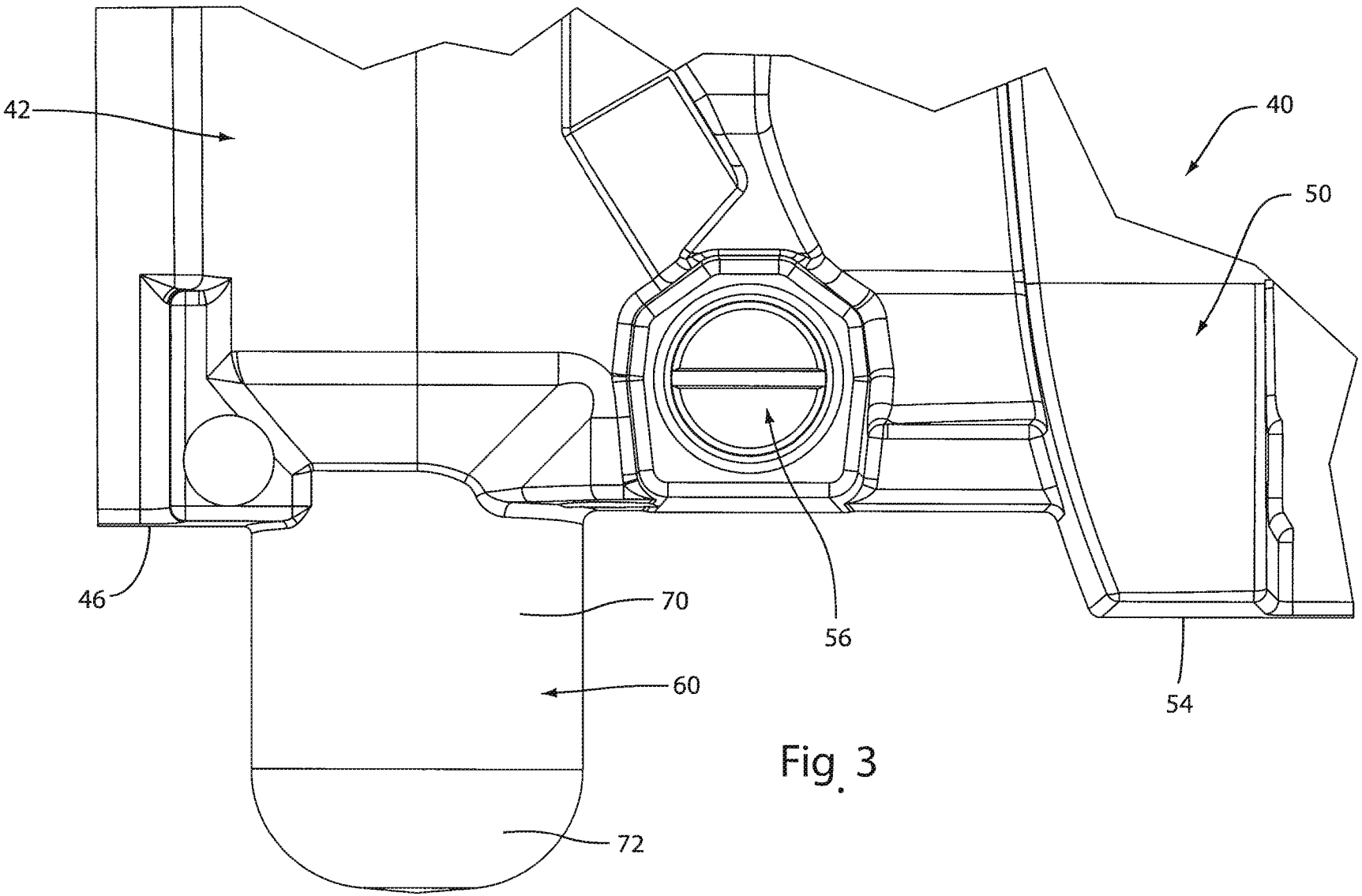
FIG. 3 is an enlarged view of a portion of FIG. 2 and illustrates a base member of the housing.

FIG. 1 illustrates an assembled electro-hydraulic actuator 10 constructed in accordance with the present invention. As shown in FIG. 1, the electro-hydraulic actuator 10 includes a housing 40. The housing 40 includes (i) an actuator portion 42 having opposite first and second ends 44 and 46 (FIG. 2), respectively, and (ii) a drive device portion 50 having opposite first and second ends 52 and 54, respectively. As best shown in FIG. 2, the actuator portion 42 and drive device portion 50 of the housing 40 are interconnected adjacent their respective second ends 46 and 54. Fluid flow conduits located internal to the housing 40 extend between the actuator portion 42 and the drive device portion 50. Flow control devices, such as valves, may be associated with these fluid flow conduits for controlling fluid flow through the housing. FIGS. 1-3 illustrate one of the valves at reference numeral 56.

The drive device portion 50 of the housing 40 supports the drive components of the electro-hydraulic actuator 10. The drive components include at least the electric motor 12 and a hydraulic pump 14. In an exemplary embodiment, the hydraulic pump 14 is a gerotor type pump that is located within the drive device portion 50 of the housing 40. Those skilled in the art will recognize that any one of various types of hydraulic pumps may be used. In the embodiment of FIG. 1, the reservoir 16 is also located within the drive device portion 50 of the housing 40 adjacent the second end 54. Also, as illustrated, the housing of the electric motor 12 extends outwardly of a first end 52 of the drive device portion 50 of the housing 40. Those skilled in the art will recognize that a separate reservoir, such as a plastic reservoir, may be used with the electro-hydraulic actuator 10. Further, the motor 12 may be located, if desired, within the drive device portion 50 of the housing 40, in which case the drive device portion may be elongated relative to that illustrated. For simplifying the packaging, the drive device portion 50 of the electro-hydraulic actuator 10 illustrated includes an integral reservoir 16 that is cast in the drive device portion during casting of the housing 40.

An interior surface of the actuator portion 42 of the housing 40 defines the cylinder bore 26 of the electro-hydraulic actuator 10. The cylinder bore 26 extends into the actuator portion 42 of the housing 40 from the first end 44 and terminates at an end wall (not shown) located a spaced distance from the second end 46. Various sealing components and closure methods may be used for closing the opening to the cylinder bore 26 located on first end 44 of the actuator portion 42 and sealing about the rod 32, when installed. The cylinder bore 26 may be cast in the actuator portion 42 during casting of the housing 40 and later honed to its desired diameter.

As set forth above, a piston 24 is located in the cylinder bore 26 of the assembled electro-hydraulic actuator 10 for dividing the cylinder bore into the first and second chambers 28 and 30. Various known sealing methods for sealing the circumference of the piston 24 may be used to prevent fluid flow between the first and second chambers 28 and 30. Movement of the piston 24 upward, as viewed in FIG. 1, results in an extension of the rod outwardly of the first end 44 of the actuator portion 42. Movement of the piston 24 downward, as viewed in FIG. 1, results in a retraction of the rod 32 relative to the first end 44 of the actuator portion 42 of the housing 40.

A base member 60 extends outwardly of the second end 46 of the actuator portion 42 of the housing 40. Alternatively, the base member 60 may extend outwardly of the second end 54 of the drive device portion 50 of the housing 40. The base member 60 is a monolithic structure that is formed as one piece with the remainder of the housing 40. Preferably, the base member 60 is formed as one piece with the housing 40 during a casting process in which the housing as a whole is formed. Typically, the housing 40 is cast from aluminum.

FIG. 3 illustrates an enlarged view of a portion of FIG. 2 and illustrates the base member 60 of the housing 40. As illustrated in FIG. 2, the base member 60 extends axially outwardly from the second end 46 of the actuator portion 42 of the housing 40 in a direction parallel to a centerline 66 of the actuator portion. Thus, the cylinder bore 26, which is also centered along the centerline 66 of the actuator portion 42, and the base member 60 are coaxial. The base member 60 includes a cylindrical portion 70 located immediately adjacent the second end 46 of the actuator portion 42 and a tapered end portion 72 located a spaced distance away from the second end 46. The base member 60 is a solid structure. The axial distance from the second end 46 of the actuator portion 42 by which the base member 60 extends may be varied. The base member 60 enables late stage configuration of the electro-hydraulic actuator 10 by enabling adaptation of the housing 40 to include any one of various attachment interface configurations.

The housing 40 of the electro-hydraulic actuator 10 may be a short bore housing or a long bore housing. A short bore housing is a housing in which the axial distance between the first and second ends 44 and 46 of the actuator portion 42 is relatively short, such as having a distance of approximately four inches. A long bore housing is a housing in which the actuator portion 42 of the housing 40 is relatively long, such as eight inches. The base member 60 may be used with various configurations and various sizes of the actuator portion 42 of the housing 40. For example, it may be used with any bore size and any stroke size.

Figure 4A:
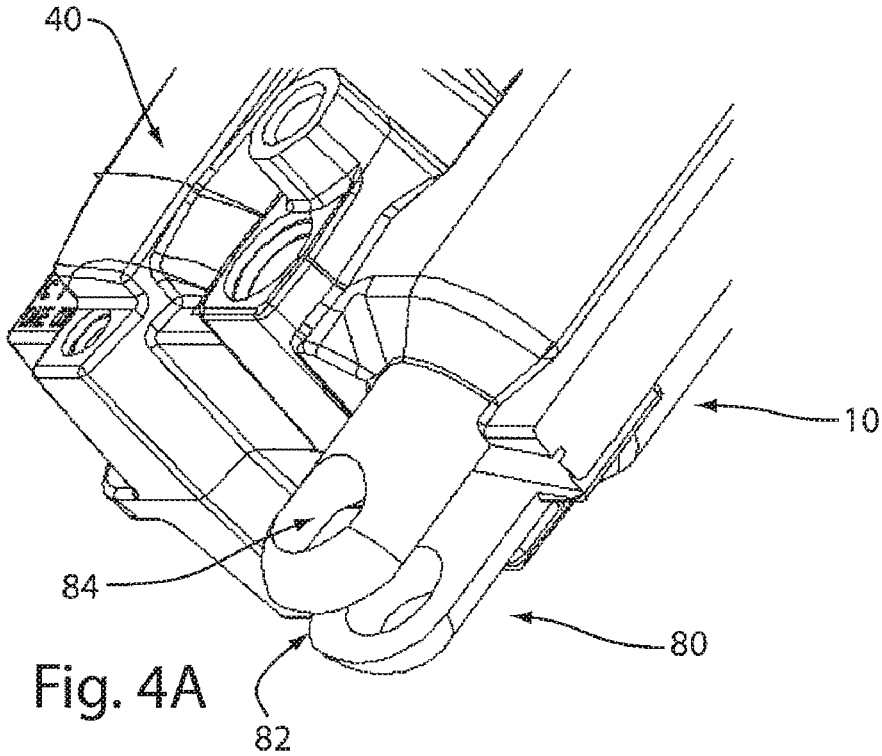
FIGS. 4A-4D illustrate various configurations of attachment interfaces that may be formed from the base member of the electro-hydraulic actuator of the present invention.
Figure 4B:
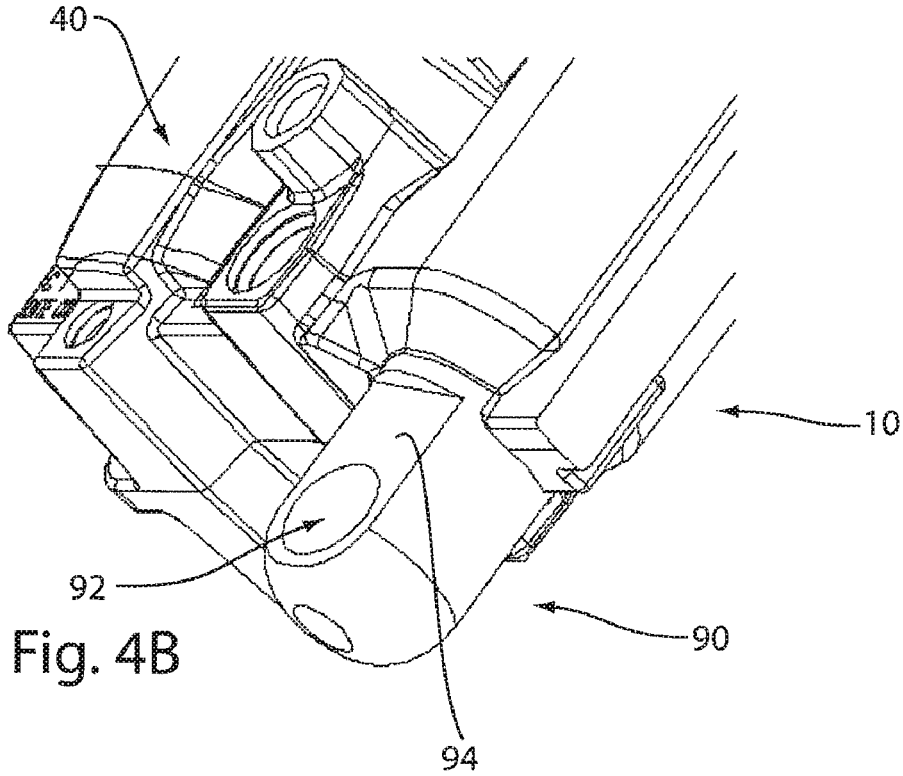
Figure 4C:
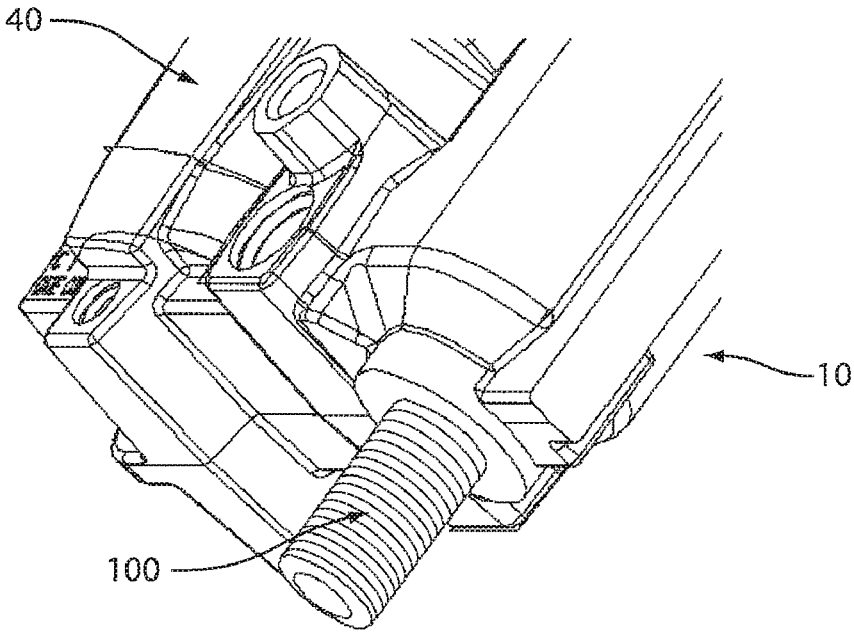
Figure 4D:
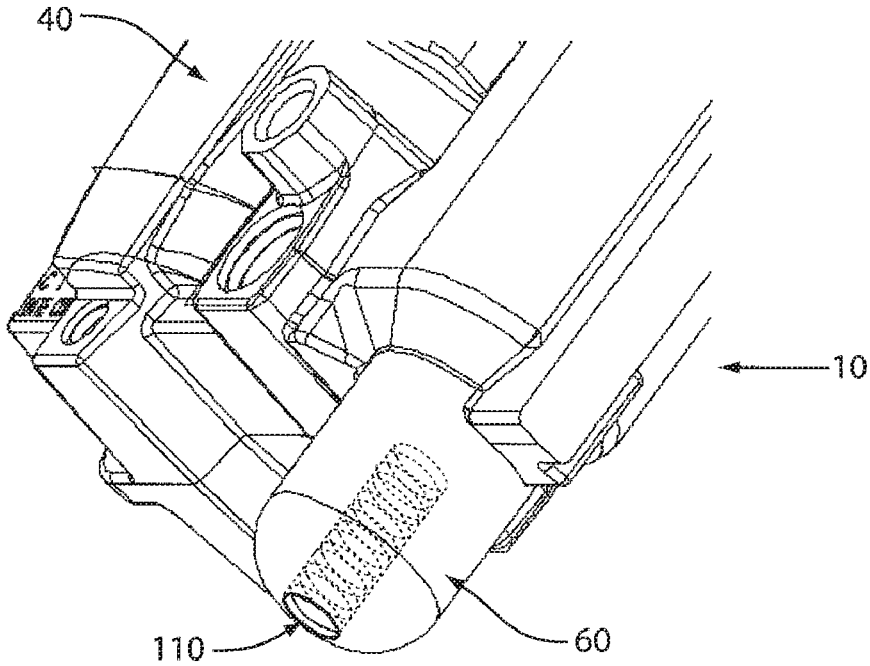

FIGS. 4A-4D illustrate various configurations of attachment interfaces that may be formed from the base member 60 of the electro-hydraulic actuator 10 of the present invention. Each of the various configurations of the attachment interface illustrated in FIGS. 4A-4D is formed by machining the base member 60 into the desired configuration. FIG. 4A illustrates a female clevis 80. In forming the female clevis 80, a groove 82 is machined in the base member 60 to bisect the base member. A through hole 84 is machined into the base member 60 in a direction perpendicular to the centerline 66 of the actuator portion 42. The groove 82 is sized for receiving a male clevis and, the through hole 84 is sized for receiving a locking pin. FIG. 4B illustrates a male clevis 90. To configure the base member 60 into a male clevis 90, a through hole 92 is machined into the base member 60 in a direction perpendicular to the centerline 66. Also, flats 94 are formed on opposite sides of the male clevis 90 for sizing the male clevis for insertion into a groove of female clevis. FIG. 4C illustrates a threaded stud 100. To form the base member 60 into a threaded stud 100, the base member 60 is machined into a cylindrical member having an outer diameter equal to that of the outer thread diameter of the stud 100 and threads thereafter are machined into the outer surface of the cylinder. FIG. 4D illustrates a threaded bore 110 formed in the base member 60. To form the attachment interface of FIG. 4D, the base member 60 is machined to the desired dimensions and a threaded bore is machined into an end surface.

Figure 5:
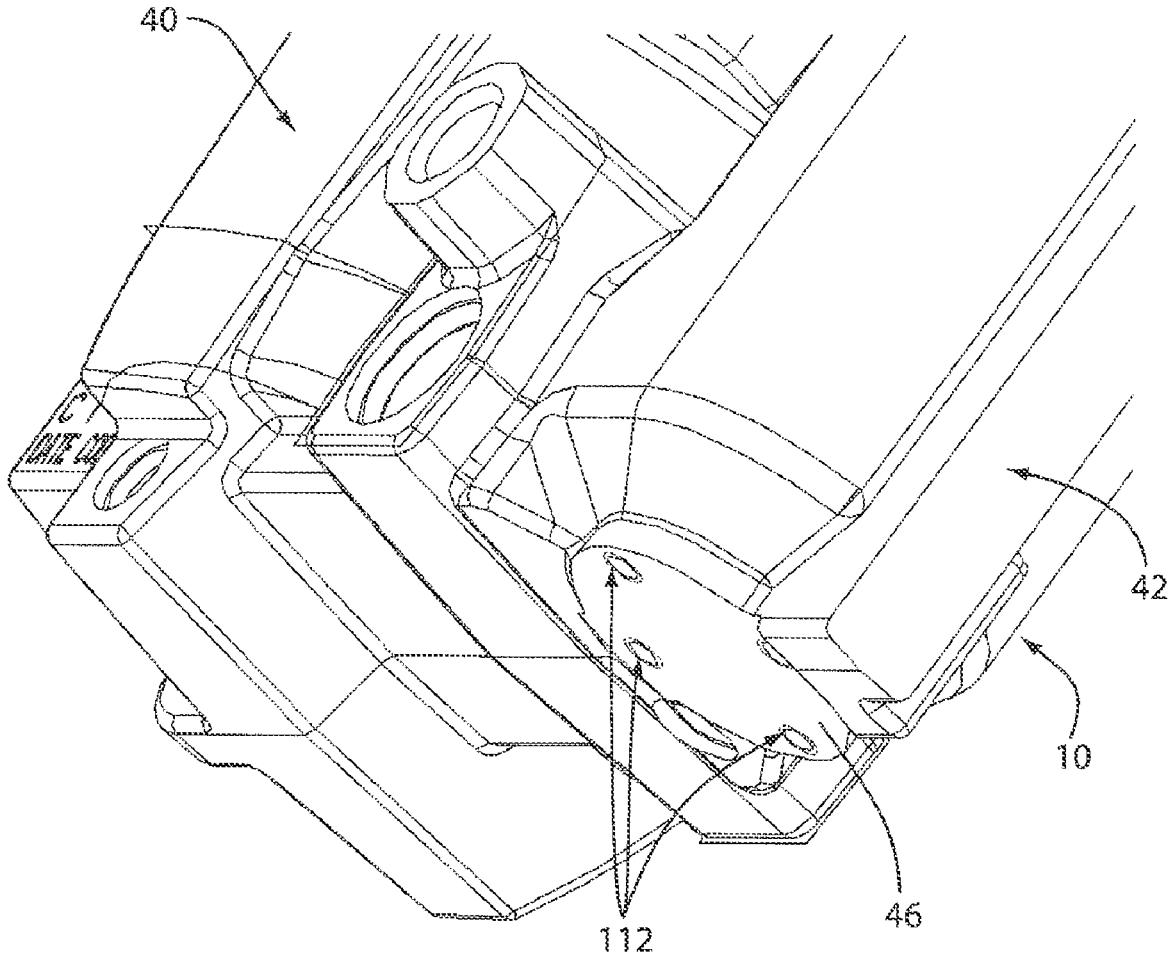
FIG. 5 illustrates the electro-hydraulic actuator with the base member completely removed.

In FIG. 5, the base member 60 is completely removed from the housing 40. In certain applications an end user may prefer to have no attachment interface extending outwardly from a second end 46 of the actuator portion 42 of the housing 40. In such case, the base member 60 may be machined completely off of the housing 40 and attachment features, such as threaded blind holes 112 may be machined into the second end 46 of the actuator portion 42.

Figure 6B:
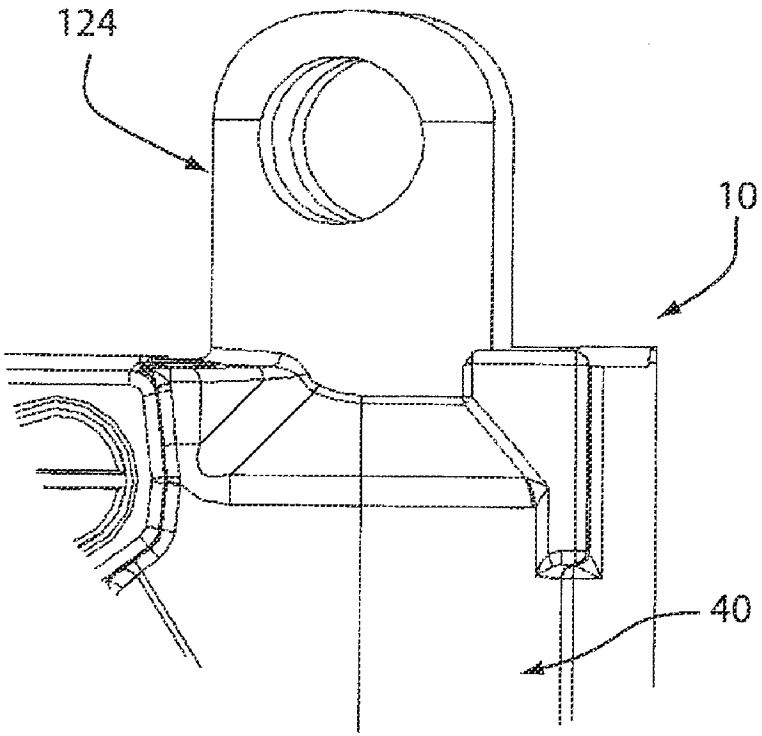
FIGS. 6A-6B illustrate an alternative attachment interface that may be formed from the base member of the electro-hydraulic actuator of the present invention with FIG. 6A being a partial sectional top view and FIG. 6B being an elevational view.
Figure 6A:
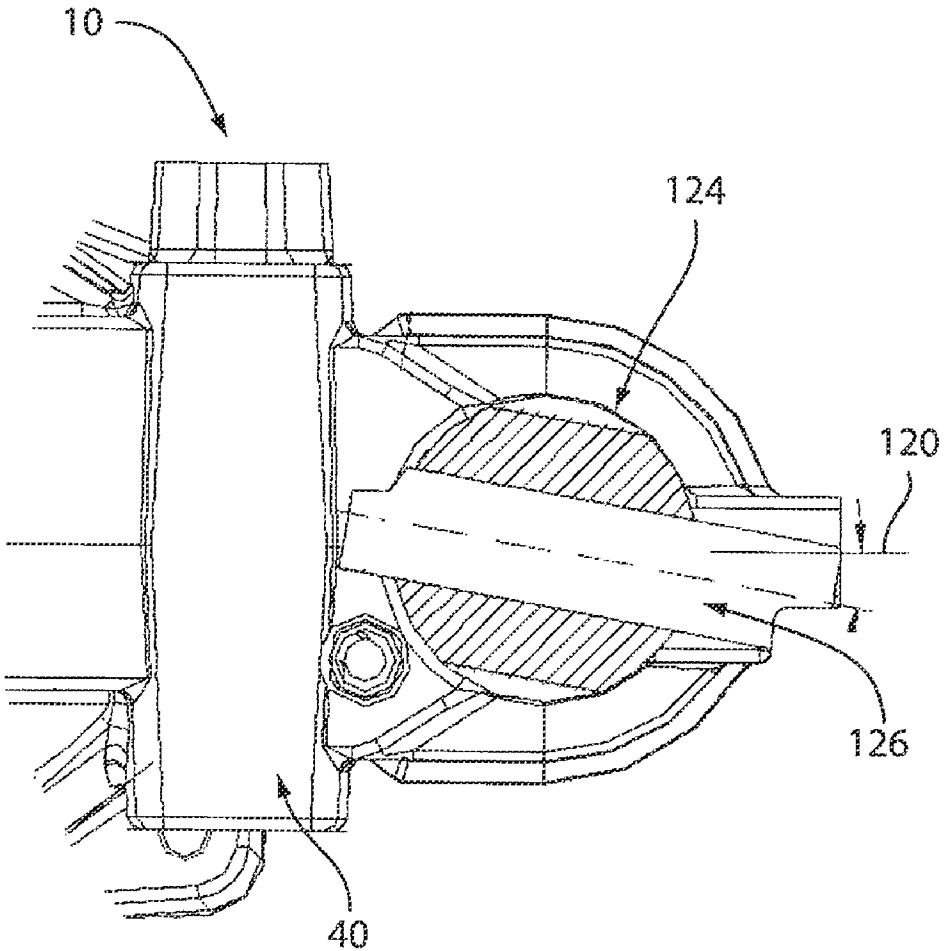

FIGS. 6A and 6B illustrate another advantage of including the base member 60 with the housing 40 of the electro-hydraulic actuator 10. The cylindrical portion 70 of the base member 60 enables the attachment interface to be formed at any one of various angles relative to the remainder of the housing 40. The reference to angles in FIGS. 6A and 6B are references relative to a plane that extends through the centerlines of both the drive device portion 50 and the actuator portion 42 of the housing 40. The plane is shown at reference numeral 120 in FIG. 6A. In prior art electro-hydraulic actuators, each angle of the attachment interface, such as a female clevis, required casting a separate housing. Each housing requires dedicated tooling. The base member 60 of the present invention allows a single housing 40 to be cast and thereafter, machined into the desired configuration including the angle of orientation. FIGS. 6A and 6B illustrate a female clevis 124 with a groove 126 that is at an angle offset relative to the plane 120. FIG. 4A illustrates a female clevis 80 with a groove 82 that is parallel to the plane 120. Both the female clevis 80 of FIG. 4A and the female clevis 124 of FIG. 6A are formed by machining the base member 60.

As stated earlier, the inclusion of the base member 60 enables late stage configurability of the electro-hydraulic actuator 10. The electro-hydraulic actuator 10 may be completely assembled prior to configuration of the attachment interface from the base member 60. For example, the electric motor 12, pump 14, reservoir 16 and all relevant valving, as well as the piston 24 and rod 32 may all be built into the electro-hydraulic actuator 10 prior to configuration of the attachment interface from the base member 60. The inclusion of the base member 60 advantageously enables stocking of only a single unit for each bore size and stroke size electro-hydraulic actuator 10 offered. This reduces inventory relative to that required with prior art designs in which a different part number and different tooling is required for the formation of each variation of the attachment interface for the housing.

According to one method of manufacturing the electro-hydraulic actuator 10 of the present invention, the housing 40 is cast as a single monolithic piece including the actuator portion 42, the drive device portion 50 and the base member 60. The housing 40 is appropriately honed to complete the cylinder bore 26 and all desired machining for receptacles for valving and other devices is completed. The electro-hydraulic actuator 10 then is assembled by placing the piston 24 in the cylinder bore 26 and appropriately closing the opening to the cylinder bore and sealing about the rod 32. The desired valving is inserted into the machined receptacles in the housing 40. The electric motor 12 is drivingly attached to the hydraulic pump 14 and the pump and motor are attached to the drive device portion of the housing 40. Such connection may be by threading or any other means. Appropriate amounts of fluid are inserted into the reservoir 16 of the housing 40 and the reservoir is appropriately plugged and sealed. The fully assembled electro-hydraulic actuator 10 then may be stocked in inventory until an order is received indicating the desired configuration of the attachment interface. After receipt of the order from the customer, the base member 60 of the housing 40 may be machined into the desired attachment interface configuration.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

What is claimed is:

1. An electro-hydraulic actuator comprising:

a hydraulic pump;

an electric motor operatively connected to the hydraulic pump and operable for driving the pump;

an actuator moveable in response to fluid flow from the pump; and a housing for the pump, electric motor and actuator, the housing having a base member that is adapted to be modified into various configurations for forming an attachment interface for mounting of the electro-hydraulic actuator, wherein the housing includes a drive device portion containing the electric motor and pump, and an actuator portion laterally offset from the drive device portion, the actuator portion containing a cylinder bore and a piston movable in the cylinder bore, the piston having a rod extending through a first end of the actuator portion, and the base member being formed on a second end of the actuator portion opposite the first end.

2. The electro-hydraulic actuator of claim 1 wherein the base member is a solid, monolithic structure that is formed as one piece with the housing.

3. The electro-hydraulic actuator of claim 1 wherein the housing is formed by casting, the base member being cast with the housing as a single monolithic structure.

4. The electro-hydraulic actuator of claim 1 wherein the base member is coaxial with the cylinder bore.

5. The electro-hydraulic actuator of claim 1 wherein the base member includes a cylindrical portion located immediately adjacent to the second end of the actuator portion of the housing.

6. The electro-hydraulic actuator of claim 1 wherein the attachment interface may be any one of a male clevis, a female clevis, a threaded stud, and a protrusion having a threaded bore.

7. The electro-hydraulic actuator of claim 1 wherein the centerlines of the actuator portion and the drive device portion extending generally parallel to one another, the base member enabling the attachment interface to be formed at any angle relative to a plane extending through the centerlines of the actuator portion and the drive device portion.

8. The electro-hydraulic actuator of claim 1 wherein the base member is axially aligned with the rod.

9. A method of manufacturing an electro-hydraulic actuator comprising:

casting a housing as a single monolithic piece including an actuator portion, a device drive portion, and a base member;

machining the housing, wherein the machining does not include machining the base member into an attachment interface;

assembling a piston in a cylinder bore within the housing, sealing around a rod of the piston, and drivingly attaching a motor to a hydraulic pump; and thereafter machining the base member into a desired attachment interface configuration.

10. The method of claim 9, wherein machining the base member includes machining after receipt of an order from a customer.

* * * * *